US007521627B2

(12) United States Patent
Sasaki

(10) Patent No.: US 7,521,627 B2
(45) Date of Patent: Apr. 21, 2009

(54) AUTOMATIC PLAYER MUSICAL INSTRUMENT, AUTOMATIC PLAYER INCORPORATED THEREIN AND METHOD USED THEREIN

(75) Inventor: Tomoya Sasaki, Shizuoka-ken (JP)

(73) Assignee: Yamaha Corporation, Shizuoka-Ken (JP)

( * ) Notice: Subject to any disclaimer, the term of this patent is extended or adjusted under 35 U.S.C. 154(b) by 0 days.

(21) Appl. No.: 12/037,953

(22) Filed: Feb. 27, 2008

(65) Prior Publication Data

US 2008/0156181 A1 Jul. 3, 2008

Related U.S. Application Data

(62) Division of application No. 11/227,020, filed on Sep. 15, 2005, now Pat. No. 7,361,828.

(30) Foreign Application Priority Data

Sep. 15, 2004 (JP) ..... 2004-268458

(51) Int. Cl.
*G10H 1/06* (2006.01)

(52) U.S. Cl. ..... 84/735; 84/692; 84/719; 84/723; 84/742; 84/744

(58) Field of Classification Search ..... None
See application file for complete search history.

(56) References Cited

U.S. PATENT DOCUMENTS

| | | | |
|---|---|---|---|
| 5,530,198 | A | 6/1996 | Ishii |
| 5,627,333 | A | 5/1997 | Stahnke et al. |
| 6,245,985 | B1 | 6/2001 | Sasaki et al. |
| 6,271,447 | B1 | 8/2001 | Fujiwara et al. |
| 6,359,207 | B1 | 3/2002 | Oba et al. |
| 6,683,242 | B2 | 1/2004 | Inoue et al. |
| 6,933,435 | B2 | 8/2005 | Kato et al. |

FOREIGN PATENT DOCUMENTS

| | | |
|---|---|---|
| JP | 2737669 | 1/1998 |
| JP | 10228276 | 8/1998 |
| JP | 2923541 | 5/1999 |

*Primary Examiner*—Marlon T Fletcher
(74) *Attorney, Agent, or Firm*—Harness, Dickey & Pierce, PLC

(57) ABSTRACT

An automatic player piano is fabricated on the basis of an acoustic piano, and an automatic player is expected to give rise to key motion for reenacting performance with solenoid-operated key actuators; since the hammers of acoustic piano are different in mass, the load against the key motion is also different among the keys; while the motion controller is forcing the keys to travel on reference key trajectories through a servo control loop, the motion controller takes the pitched part into account, and selectively accesses control parameter tables so as to read out the approximate control parameters for the individual keys, whereby the hammers surely reach the target final hammer velocity before striking the strings.

3 Claims, 7 Drawing Sheets

| | rv≦200mm/s rx=0 to ⌈6-0.04(KN-1)⌋mm | rv≦200mm/s rx=⌈6-0.04(KN-1)⌋to10mm | rv>200mm/s rx=0to⌈6-0.04(KN-1)⌋mm | rv>200mm/s rx=⌈6-0.04(KN-1)⌋to10mm |
|---|---|---|---|---|
| Kx | 0. 6 | 0. 2 | 0. 6 | 0. 2 |
| Kv | 0. 3 | 0. 3 | 0. 3 | 0. 3 |
| ADDEND u | 9% | 9% | 9+2×(rv-100)/100% | 9+2×(rv-100)/100% |

Fig. 4 A

| | rv≦200mm/s rx=0to 4mm | rv≦200mm/s rx=4to 10mm | rv>200mm/s rx=0to 4mm | rv>200mm/s rx=4to 10mm |
|---|---|---|---|---|
| Kx | 0. 6 | 0. 2 | 0. 6 | 0. 2 |
| Kv | 0. 3 | 0. 3 | 0. 3 | 0. 3 |
| ADDENDu | 9% | 9% | 9+2×(rv-100)/100% | 9+2×(rv-100)/100% |

Fig. 4 B

| | RELEASED KEYS |
|---|---|
| Kx | 0. 2 |
| Kv | 0. 7 |
| ADDEND u | 9% |

Fig. 4 D

| | rv≦200mm/s rx=0to 4mm | rv≦200mm/s rx=4to 10mm | rv>200mm/s rx=0to 4mm | rv>200mm/s rx=4to 10mm |
|---|---|---|---|---|
| Kx | 0.6-(KN-68)/100 | 0. 2 | 0.6-(KN-68)/100 | 0. 2 |
| Kv | 0. 3 | 0. 3 | 0. 3 | 0. 3 |
| ADDEND u | 9% | 9% | 9+2×(rv-100)/100% | 9+2×(rv-100)/100% |

Fig. 4 C

| | UNMOVED KEYS |
|---|---|
| Kx | Kx*1.5 |
| Kv | Kv*0.3 |
| ADDEND u | 15% for 30ms at end of trajectry |

Fig. 4 E

AUTOMATIC PLAYER MUSICAL INSTRUMENT, AUTOMATIC PLAYER INCORPORATED THEREIN AND METHOD USED THEREIN

CROSS-REFERENCE TO RELATED APPLICATIONS

This application is a divisional of U.S. patent application Ser. No. 11/227,220 filed on Sep. 15, 2005, and claims the benefit of Japanese Patent Application No 2004-268458 filed Sep. 15, 2004. The disclosure of the above applications are incorporated herein by reference.

FIELD OF THE INVENTION

This invention relates to an automatic playing technology and, more particularly, to an automatic player musical instrument, an automatic player incorporated therein and a method used therein.

DESCRIPTION OF THE RELATED ART

An automatic player piano is a typical example of the automatic player musical instrument. The automatic player piano is fabricated from an acoustic piano and an automatic playing system, and the automatic playing system selectively gives rise to the key motion on the basis of music data codes such as those defined in the MIDI (Musical Instrument Digital Interface) protocols. The key motion gives rise to the rotation of the hammers through the action units, and the hammers are brought into collision with the strings at the end of the rotation. Then, the strings start to vibrate, and the vibrations give rise to the piano tones.

The loudness of piano tones is proportional to the hammer velocity immediately before the strikes at the strings, and the hammer velocity is proportional to the key velocity at the certain points on the key trajectories. For this reason, it is possible to adjust the piano tones to target loudness by controlling the black and white keys. The certain points are hereinafter referred to as "reference key points", and the key velocity at the reference key points is referred to as "reference key velocity". The key trajectories previously determined on the basis of the music data codes are hereinafter referred to as "reference key trajectories". The black and white keys pass the reference key points at target values of the reference key velocity in so far as the black and white keys travel on the reference key trajectories.

Solenoid-operated key actuators are respectively provided under the rear portions of the black and white keys, and a data processing unit controls the plungers with a driving signal selectively supplied to the solenoid-operated key actuators. The plunger motion gives rise to the key motion, and the plunger stroke is proportional to the mean current of the driving signal. In other words, it is possible to control the key velocity with the driving signal. For this reason, the automatic player adjusts the tones to target values of the loudness by means of the driving signal.

The solenoid-operated key actuators and suitable sensors form a servo-control loop together with the data processing unit. The key velocity is varied with the mean current of the driving signals, the data processing unit periodically checks pieces of key data representative of the key motion to see whether or not the black and white keys travel on the reference key trajectories. The data processing unit keeps the driving signal at the target values of the mean current in so far as the black and white keys are traveling on the reference key trajectories. However, if the black and white keys are deviated from the reference key trajectories, the data processing unit increases or decreases the target values of mean current so as to force the black and white keys to travel on the reference key trajectories. Thus, the black and white keys are put under the control of the servo-control loop during the automatic playing.

The prior art servo-control techniques are disclosed in Japanese Patent Publication Nos. 2923541 and 2737669 and Japanese Patent Application laid-open No. Hei 10-228276. Japanese Patent Publication No. 2737669 is based on Japanese Patent Application No. Hei 6-272282, which offered the Convention Priority right to U.S. Ser. No. 08/352,543. The U.S. Patent Application was patented, and U.S. Pat. No. 5,530,198 was assigned to the U.S. Patent.

In the prior art servo-control techniques disclosed in Japanese Patent Publication Nos. 2923541 and 2737669, the key motion is controlled through comparison of the target key velocity and target keystroke with the actual key velocity and actual keystroke reported from the sensors. The constant and gains are arbitrarily given to the amplifiers and adder, which are implemented by the data processing unit, from the outside in the prior art servo-control technique disclosed in Japanese Patent Application laid-open No. Hei 10-228276, and the constant and gains are expected to remove the individuality of product from the prior art automatic player piano.

Although the prior art automatic player piano exactly reproduces the tones on a music passage at the target values of the pitch, the audience sometimes feels the loudness of tones different from that to be expected. Thus, the problem inherent in the prior art automatic player piano is the low fidelity.

SUMMARY OF THE INVENTION

It is therefore an important object of the present invention to provide an automatic player musical instrument, which produces tones at target loudness in the playback.

It is also important object of the present invention to provide an automatic player, which is suitable for the automatic player musical instrument.

It is another important object of the present invention to provide a method for controlling manipulators incorporated in the automatic player musical instrument.

The present inventor contemplated the problem inherent in the prior art automatic player piano, and noticed that the load against the key motion was different among the black and white keys. Especially, the hammers were differently weighted depending upon the pitched parts. The hammers for the lower pitched part were the heaviest, and the hammers for the higher pitched part were lightest. If the solenoid-operated key actuators exerted certain force on the black and white keys in the lower pitched part, the action units pushed the hammers, and gave rise to the free rotation at small acceleration through the escape of the jacks. However, when the solenoid-operated key actuators exerted the certain force on the black and white keys in the higher pitched part, the action units also pushed the hammers, and gave rise to the free rotation at large acceleration through the escape. The difference in acceleration resulted in the difference in final hammer velocity and, accordingly, loudness. The present inventor concluded that, even though the tones were to be produced at same loudness, the mean current was to be gradated depending upon the load against the black and white keys.

To accomplish the object, the present invention proposes to take the mass of hammers into account when a controller determines the magnitude of driving signals.

In accordance with one aspect of the present invention, there is provided an automatic player musical instrument for reenacting a performance represented by a set of pieces of music data comprising a musical instrument including plural link works selectively driven to specify tones to be produced and having different values of mass and a tone generator energized by the link works so as to produce the tones, and an automatic player including plural actuators respectively associated with the plural link works and responsive to driving signals so as selectively to exert force on the plural link works, thereby driving the associated link works to travel on respective reference trajectories determined on the basis of the pieces of music data without fingering of a human player, plural sensors producing detecting signals representative of an actual physical quantity expressing motion of the plural link works and a controller connected to the plural actuators and the plural sensors for producing a servo control loop, determining values of the magnitude of the driving signals on the basis of a difference between the motion expressed by the actual physical quantity and the motion presently expected on the reference trajectories and control parameters, which are varied together with the mass and the motion, and adjusting the driving signals to the values of the magnitude.

In accordance with another aspect of the present invention, there is provided an automatic player used for a musical instrument including plural link works selectively driven to specify tones to be produced and having different values of mass and a tone generator energized by the link works so as to produce the tones, and the automatic player comprises plural actuators respectively associated with the plural link works and responsive to driving signals so as selectively to exert force on the plural link works, thereby driving the associated link works to travel on respective reference trajectories determined on the basis of the pieces of music data without fingering of a human player, plural sensors producing detecting signals representative of an actual physical quantity expressing motion of the plural link works and a controller connected to the plural actuators and the plural sensors for producing a servo control loop, determining values of the magnitude of the driving signals on the basis of a difference between the motion expressed by the actual physical quantity and the motion presently expected on the reference trajectories and control parameters, which are varied together with the mass and the motion, and adjusting the driving signals to the values of the magnitude.

In accordance with yet another aspect of the present invention, there is provided a method for reenacting a performance represented by a set of pieces of music data through a musical instrument comprising the steps of a) determining a reference trajectory, on which a linkwork incorporated in the musical instrument is to travel so as to cause a tone generator to produce a tone, on the basis of a piece of music data incorporated in the set, b) acquiring a piece of detecting data representative of an actual physical quantity expressing motion of the linkwork, c) comparing the motion expressed by the actual physical quantity with the motion presently expected on the reference trajectory to see whether or not a difference takes place therebetween, d) determining control parameters varied together with the motion and mass of the linkwork when the answer at the step c) is given affirmative, e) determining a new value of magnitude of a driving signal on the basis of the difference and the control parameters, f) supplying the driving signal to an actuator associated with the linkwork so that the actuator exerts force corresponding to the new value of the magnitude to the linkwork, thereby forcing the linkwork to travel on the reference trajectory, g) keeping the driving signal at a prevent value of the magnitude so that the linkwork continuously travels on the reference trajectory when the answer at the step c) is given negative, and h) repeating the steps a) to g) until the linkwork reaches the end of the reference trajectory.

BRIEF DESCRIPTION OF THE DRAWINGS

The features and advantages of the automatic player musical instrument, automatic player and method will be more clearly understood from the following description taken in conjunction with the accompanying drawings, in which FIGS. 4A to 4E are views showing the contents of control parameter tables.

DESCRIPTION OF THE PREFERRED EMBODIMENTS

Figure 1:
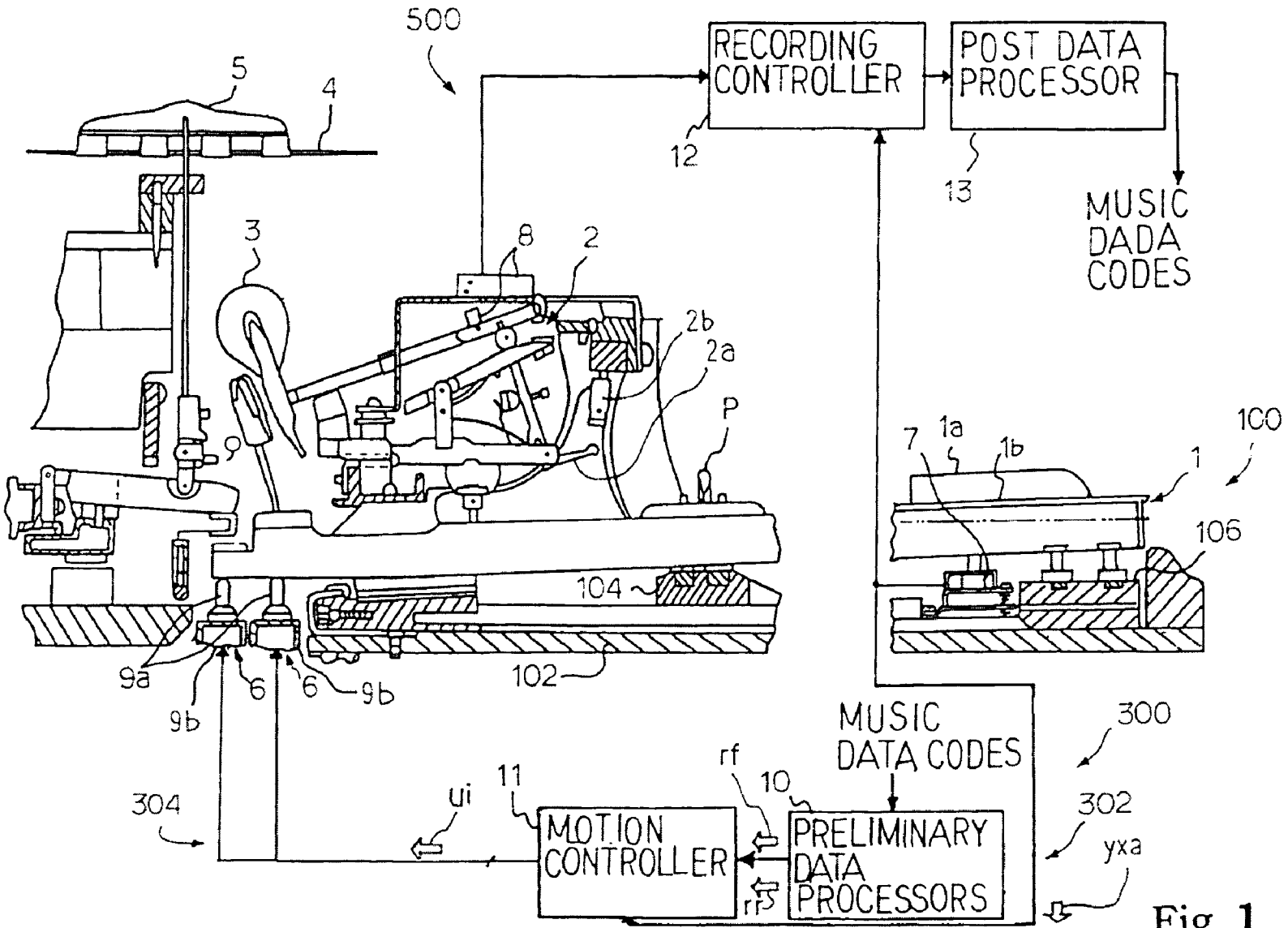
FIG. 1 is a side view showing the structure of an automatic player piano according to the present invention.

An automatic player musical instrument embodying the present invention largely comprises a musical instrument and an automatic player. A human player can play a piece of music on the musical instrument, and the automatic player also plays the piece of music expressed by a set of music data on the musical instrument.

The musical instrument includes plural link works and a tone generator. The link works have individual values of mass so that the human player and automatic player selectively drive the plural link works against the mass during the performance. Thus, the plural link works serve the load on the fingers of the human player and the automatic player. The link works thus selectively driven energize the tone generator, and the tone generator produces the tones specified through the link works.

In case of where an acoustic piano serves as the musical instrument, black and white keys, action units, hammers and dampers form the plural link works, and strings serve as the tone generator. Since the hammers are graded by the pitch of tones produced from the associated strings, the link works are also different in mass, and the human player and automatic player are expected delicately to vary the force exerted on the black and white keys.

The automatic player includes plural actuators, plural sensors and a controller. The plural actuators are respectively provided for the plural link works, and give rise to the motion of the associated link works against the load in response to driving signals. On the other hand, the plural sensors monitor the plural link works, respectively, and produce detecting signals expressing the motion of the associated link works. The plural actuators and plural sensors are connected to the controller so that the controller, plural actuators and plural sensors form in combination a servo-control loop for the plural manipulators.

When a user wishes to produce a piece of music, he or she instructs the automatic player to perform the piece of music. Then, a set of music data, which expresses the piece of music, is supplied to the controller. The controller sequentially analyzes the pieces of music data, and determines reference trajectories for the link works to be moved. The servo-control loop forces the link works to travel on the individual reference trajectories so as to produce the tones at target values of loudness.

When the timing to produce a tone comes, the controller starts the servo control. The servo control loop achieves a travel of the link work along the reference trajectory as follows. The controller determines target motion of the link work on the basis of the piece of music data, and analyzes the detecting signal so as to determine the actual motion of the link work. The controller compares the actual motion with the target motion to see whether or not difference takes place between the target motion and the actual motion.

The difference is assumed to occur. The controller determines control parameters on the basis of the motion of the link work and the mass of the link work. The term "motion" means either target motion or actual motion. When the control parameters are determined, the controller further determines the magnitude of the driving signal to be supplied to the associated actuator on the basis of the control parameters and difference between the actual motion and the target motion.

The controller adjusts the driving signal to the value of magnitude, and supplies the driving signal to the actuator associated with the link work. Since the actuator exerts the force equivalent to the magnitude of the driving signal on the link work, the link work is accelerated or decelerated. In other words, the difference is eliminated from between the target motion and the actual motion.

The controller repeats the above-described control sequence through the servo control loop so as to force the link work to travel on the reference trajectory. The link work thus traveling on the reference trajectory appropriately energizes the tone generator at the end of the reference trajectory so that the tone generator produces the tone expressed by the piece of music data.

As will be appreciated, although the link works have the different values of mass, the controller adjusts the driving signal to a proper value of the magnitude, and optimizes the force exerted on the link works. If a link work to be driven is heavier than another link work already driven is, the controller adjusts the driving signal to the magnitude larger than that of the driving signal already supplied to the actuator. Thus, the controller regulates the driving signals to the proper values as if all the link works are equal in mass to one another. This results in the performance at high fidelity.

In the following description, term "front" is indicative of a position closer to a player, who is sitting on a stool for fingering, than a position modified with term "rear". A line drawn between a front position and a corresponding rear position extends in "fore-and-aft direction", and "lateral direction" crosses the fore-and-aft direction at right angle.

FIRST EMBODIMENT

Referring to FIG. 1 of the drawings, an automatic player piano embodying the present invention largely comprises an acoustic piano 100 and an electric system, which serves as an automatic playing system 300 and a recording system 500. The automatic playing system 300 and recording system 500 are installed in the acoustic piano 100, and are selectively activated depending upon the mode of operation. While a player is fingering a piece of music on the acoustic piano 100 without any instruction for recording and playback, the acoustic piano 100 behaves as similar to a standard acoustic piano, and generates the piano tones at the pitch specified through the fingering.

When the player wishes to record his or her performance on the acoustic piano 100, the player gives the instruction for the recording to the electric system, and the recording system 500 gets ready to record the performance. In other words, the recording system 500 is activated. While the player is fingering a music passage on the acoustic piano 100, the recording system 500 produces music data codes representative of the performance on the acoustic piano 100, and the set of music data codes are stored in a suitable memory forming a part of the electric system or remote from the automatic player piano. Thus, the performance is memorized as the set of music data codes.

A user is assumed to wish to reproduce the performance. The user instructs the electric system to reproduce the acoustic tones. Then, the automatic playing system 300 gets ready for the playback. The automatic playing system 300 fingers the piece of music on the acoustic piano 100, and reenacts the performance without any fingering of the human player.

The acoustic piano 100, automatic playing system 300 and recording system 500 are hereinafter described in detail.

Acoustic Piano

In this instance, the acoustic piano 100 is a grand piano. The acoustic piano 100 includes a keyboard 1, action units 2, hammers 3, strings 4 and dampers 5. A key bed 102 forms a part of a piano cabinet, and the keyboard 1 is mounted on the key bed 102. The keyboard 1 is linked with the action units 2 and dampers 5, and a pianist selectively actuates the action units 2 and dampers 5 through the keyboard 1. The dampers 5, which have been selectively actuated through the keyboard 1, are spaced from the associated strings 4 so that the strings 4 get ready to vibrate. On the other hand, the action units 2, which have been selectively actuated through the keyboard 1, give rise to free rotation of the associated hammers 3, and the hammers 3 strike the associated strings 4 at the end of the free rotation. Then, the strings 4 vibrate, and the acoustic tones are produced through the vibrations of the strings 4.

A jack 2*a* and a regulating button 2*b* are incorporated in each of the action units 2. While the action unit 2 is staying at the rest position, the jack 2*a* is spaced from the regulating button 2*b*, and the hammer 3 is resting on the head of the jack 2*a* as shown. The pianist is assumed to start to exert the force on the action unit 2 through the keyboard 1. The action unit 2 is rotated about a whippen flange, and pushes the hammer upwardly. The toe of jack 2*a* is getting closer and closer. When the toe is brought into contact with the regulating button 2*b*, the jack 2*a* escapes from the hammer 3, and the head of jack 2*a* kicks the hammer 3. Then, the hammer 2 starts the free rotation. The hammers 3 are different in size and, accordingly, in weight. The hammers 3 for the lowest pitched part are the heaviest, and the hammers 3 for the highest pitched part are the lightest. Thus, the keyboard 1, action units 2, dampers 5, hammers 3 and strings 4 are similar in structure to and behave as similar to those of a standard acoustic piano for producing the piano tones.

The keyboard 1 includes plural black keys 1*a*, plural white keys 1*b* and a balance rail 104. In this instance, eighty-eight keys 1*a*/1*b* are incorporated in the keyboard 1, key numbers Kni where i is varied from 1 to 88 are respectively assigned to the eighty-eight black and white keys 1*a*/1*b*. The black keys 1*a* and white keys 1*b* are laid on the well-known pattern, and are movably supported on the balance rail 104 by means of balance key pins P.

While any force is not exerted on the black/white keys 1*a*/1*b*, the hammers 3 and action units 2 exert the self-weight on the rear portions of the black/white keys 1*a*/1*b*, and the front portions of the black/white keys 1*a*/ 1*b* are spaced from the front rail 106 as drawn by real lines. The key position indicated by the rear lines is "rest position", and the keystroke is zero at the rest position.

When a pianist depresses the black/white keys 1*a*/1*b*, the front portions are sunk against the self-weight of the action units/hammers 2/3. The front portions finally reach "end positions" indicated by dots-and-dash lines. The end positions are spaced from the rest positions along the key trajectories by 10 millimeters. In other words, the keystroke from the rest positions to the end positions is 10 millimeters long.

A user is assumed to depress the front portions of the black and white keys 1*a*/1*b*. The front portions are sunk toward the front rail 106, and the rear portions are raised. The key motion gives rise to the activation of the associated action units 2, and further causes the strings 4 to get ready for the vibrations as described hereinbefore. The activated action units 2 pushes the associated hammers 3, upwardly, and drive the associated hammers 3 for the free rotation through the escape. The hammers 3 strike the associated strings 4 at the end of the free rotation for producing the acoustic tones. The hammers 3 rebound on the strings 4, and are dropped onto the associated key action units 2, again.

When the user releases the black and white keys 1*a*/1*b*, the self-weight of the action units/hammers 2/3 gives rise to the rotation of the black and white keys 1*a*/1*b* in the counter direction so that the black and white keys 1*a*/1*b* return to the rest positions. The dampers 5 are brought into contact with the associated strings 4 so that the acoustic tones are decayed. The key action units 2 return to the rest positions, again. Thus, the human pianist can give rise to the angular key motion about the balance rail 104 like a seesaw.

Automatic Playing System

Description is hereinafter made on the automatic playing system 300 and recording system 500 with reference to FIG. 2 concurrently with FIG. 1. The automatic playing system 300 includes an array of key actuators 6, key sensors 7, a memory device 23, a manipulating panel (not shown) and a controller 302. On the other hand, the recording system 500 includes hammer sensors 8, the key sensors 7, memory device 23, controller 302 and manipulating panel (not shown). Thus, the system components 7, 23, controller 302 and manipulating panel (not shown) are shared between the automatic playing system 300 and the recording system 500.

The function of the controller 302, which forms a part of the automatic playing system 300, is broken down into a preliminary data processor 10 and a motion controller 11. A set of music data codes representative of a performance to be reenacted is loaded to the preliminary data processor 10. The set of music data was, by way of example, memorized in the memory device 23. The key sensors 7 supplies key position signals representative of actual key positions to the motion controller 11. The key position signals serve as feedback signals yxa.

The preliminary data processor 10 sequentially analyzes the music data codes, and determines the piano tones to be reproduced and timing at which the piano tones are reproduced. The piano tones to be produced are expressed by the key numbers Kni where i ranges from 1 to 88. When the time to start to push the black/white key 1*a*/1*b* comes, the preliminary data processor 10 determines reference key trajectories for the black/white keys 1*a*/1*b*, and supplies a control data signal rf representative of the reference key trajectories to the motion controller 11. The reference key trajectories for the depressed keys 1*a*/1*b* are usually different from the reference key trajectory for the released keys 1*a*/1*b*. For this reason, the pieces of reference trajectory data are labeled with pieces of discriminative data representative of the direction of the key motion.

The reference key trajectory is a series of target values of the key position varied with time. Thus, the control signal rf representative of the target value varied with time is supplied from the preliminary data processor 10 to the motion controller 11. The black/ white keys 1*a*/1*b* passes the reference key point at a target value of reference key velocity, and causes the associated hammer 3 to obtain the final hammer velocity, which is proportional to the loudness of tone, in so far as the associated black/white key 1*a*/1*b* exactly travels on the reference key trajectory.

The motion controller 11 supplies the driving signals ui to the solenoid-operated key actuators 6, and periodically regulates the driving signal ui to proper values of the mean current through comparison between the target key positions on the reference key trajectories and the actual key positions reported from the key sensors 7 and between target key velocity and actual key velocity so as to force the black/white keys 1*a*/1*b* to travel on the reference trajectories. The target key position and target key velocity are hereinafter labeled with "rx" and "rv", and the actual key position and actual key velocity are labeled with "yx" and "yv".

Since the end portions are spaced from the rest positions by 10 millimeters in this instance, the key stroke or target key position rv/actual key position yx are fallen within the range from zero to 10 millimeters. On the other hand, the target key velocity rv and actual key velocity yv are fallen within the range from zero to 500 millimeters per second.

On the other hand, the function of the controller 302, which forms a part of the recording system 500, is broken down into a recording controller 12 and a post data processor 13. The hammer sensors 8 supplies hammer position signals, which represent actual hammer positions, to the recording controller 12, and the recording controller 12 determines the final hammer velocity and the time at which the strings 4 are struck with the hammers 3. The recording controller 12 further determines the key numbers assigned to the depressed/released keys 1*a*/1*b*, actual key velocity and time at which the pianist starts to depress the black/white keys 1*a*/1*b*. The recording controller 12 analyzes these pieces of music data representative of the key motion and hammer motion, and supplies pieces of event data to the post data processor 13. The event data express the note-on event and note-off event defined in the MIDI protocols.

The post data processor 13 normalizes the pieces of event data so that the individuality of the automatic player piano is eliminated from the pieces of event data. The pieces of normalized event data are coded by the post data processor 13 in appropriate formats defined in the MIDI protocols.

The key actuators 6 are independently energized with the driving signal ui for pushing the associated black and white keys 1*a*/1*b*. This means that the number of key actuators 6 is equal to the number of black and white keys 1*a*/ 1*b*. In this instance, the key actuators 6 are implemented by solenoid-operated actuator units.

Each of the solenoid-operated key actuator units 6 includes a plunger 9*a* and a combined structure of solenoids and a yoke 9*b*. The solenoids are housed in the yoke, and plungers 9*a* are projectable from and retractable into the solenoids. The combined structure of solenoids and yoke 9*b* is hereinafter simply referred to as "solenoid 9*b*" or "solenoids 9*b*". The array of solenoid-operated key actuator units 6 is hung from the key bed 102. While the solenoid-operated key actuator units 6 are standing idle without any driving signal ui at an active level, the plungers 9*a* are retracted in the associated solenoids 9*b*, and the tips of the plungers 9*a* are slightly spaced from the lower surfaces of the associated black and white keys 1*a*/1*b* at the rest positions.

When the controller 302 energizes a certain solenoid 9*b* with the driving signal ui, magnetic field is created around the plunger 9*a*, and the magnetic force is exerted on the plunger 9*a* in the magnetic field. Then, the plunger 9*a* upwardly projects from the associated solenoid 9*b*, and pushes the lower surface of the rear portion of black and white key 1*a*/1*b* so as to give rise to the angular motion of the associated black/white keys 1*a*/1*b*. The black/white key 1*a*/1*b* actuates the associated action unit 2, and the jack 2*a* escapes from the hammer 3. The hammer 3 starts the free rotation through the escape, and the string 4 is struck with the hammer 3 at the end of the free rotation. Although the solenoid-operated key actuators 6, black/white keys 1*a*/1*b*, action units 2 and hammers 3 are mechanically independent of one another, the solenoid-operated key actuators 6 sequentially give rise to the key motion, escape of jacks and free rotation of hammers 3, and result in the impacts of the hammers 3 on the strings 4 so as to produce the piano tones.

The black/white keys 1*a*/1*b* are respectively monitored with the key sensors 7. The key sensors 7 are provided under the front portions of the black/ white keys 1*a*/1*b*, and have respective detectable ranges overlapped with the full keystrokes. The key sensors 7 create optical beams across the trajectories of the associated black/white keys 1*a*/1*b*, and the amount of light is varied depending upon the actual key position of the associated black/white key 1*a*/ 1*b*. Thus, the key sensors 7 are categorized in an optical position transducer, and the structure of the key sensors 7 is, by way of example, disclosed in Japanese Patent No. 2923541.

The amount of light is representative of the actual key position, and is converted to photo current. The photo current forms the key position signals yxa representative of the actual key positions, and the key position signals yxa are supplied to the controller 302. The magnitude of the key position signals yxa is varied in dependence on the actual key positions, and the rate of change expresses the key velocity. The key position signals are supplied from the key sensors 7 to both of the recording controller 12 and the motion controller 11 so as to be used in both of the recording and the servo-controlling on the black/white keys 1*a*/1*b* as described hereinbefore.

The hammer sensors 8 are also implemented by the optical position transducer. The optical position transducers disclosed in Japan Patent Application laid-open No. 2001-175262 are available for the hammer sensors 8. The hammer sensors 8 are incorporated in the recording system 500, and the hammer position signals are supplied to the recording controller 12.

Figure 2:
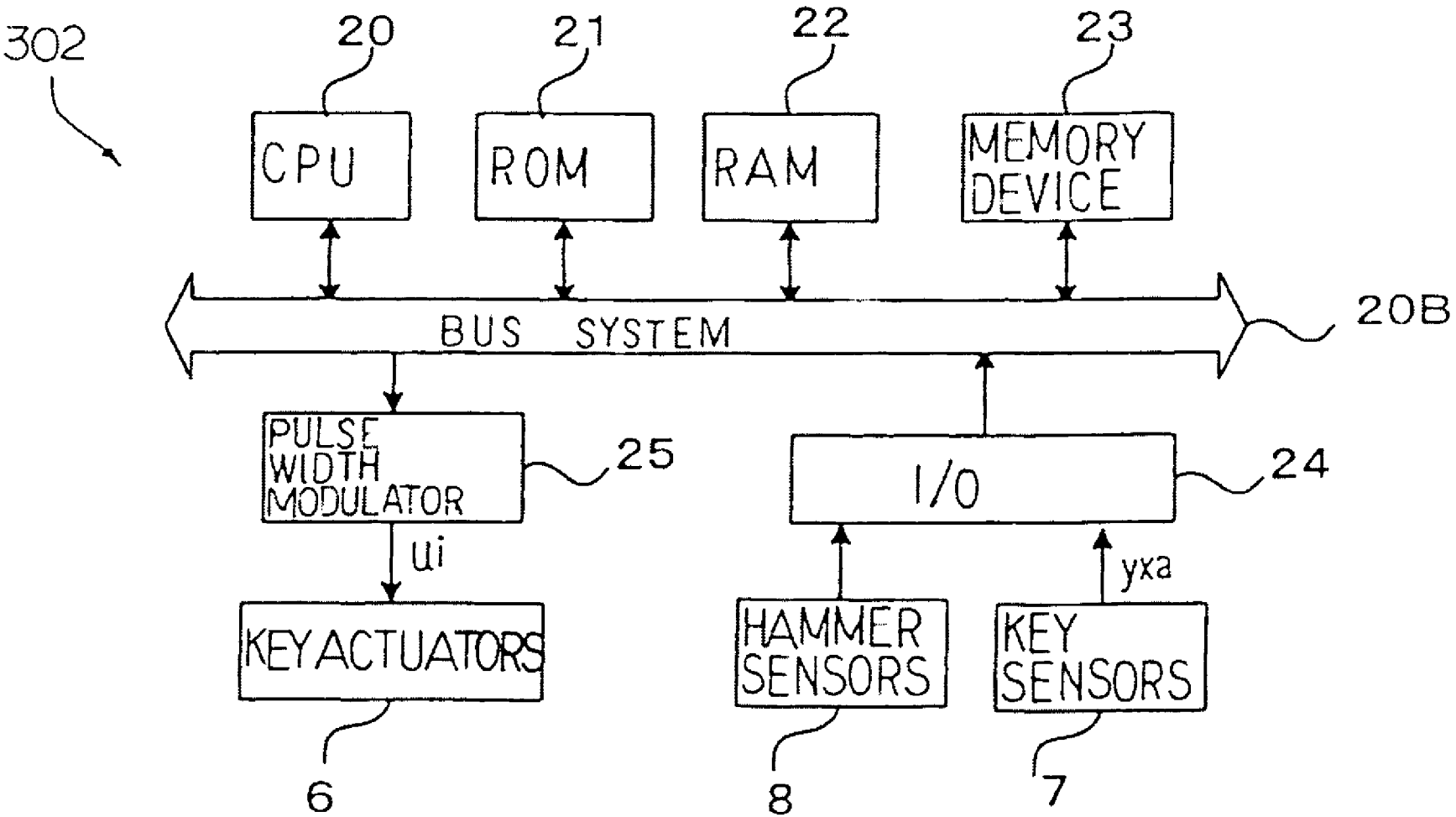
FIG. 2 is a block diagram showing the system configuration of a data processing unit incorporated in the automatic player piano.

As will be seen in FIG. 2, the controller 302 includes a central processing unit 20, which is abbreviated as "CPU", a read only memory 21, which is abbreviated as "ROM", a random access memory 22, which is abbreviated as "RAM", a bus system 20B, an interface 24, which is abbreviated as "I/O" and a pulse width modulator 25. These system components 20, 21, 22, 24 and 25 are connected to the bus system 20B, and the memory device 23 is further connected to the bus system 20B. Address codes, control data codes and music data codes are selectively propagated from particular system components to other system components through the bus system 20B. Though not shown in FIG. 2, a clock generator and a frequency divider are incorporated in the controller 302, and a system clock signal and a tempo clock signal make the system components synchronized with one another and various timer interruptions take place.

The central processing unit 20 is the origin of the data processing capability. A main routine program, subroutine programs and data/parameter tables are stored in the read only memory 21, and the computer programs runs on the central processing unit 20 so as to accomplish the jobs as the preliminary data processor 10, motion controller 11, recording controller 12 and post data processor 13. Several data tables are used for determining target values of mean current, and are referred to as "control parameter tables", which will be hereinlater described in detail. The random access memory 22 offers a temporary data storage, and serves as a working memory.

The memory device 23 offers a large amount of data holding capacity to both automatic playing and recording systems 300/500. The music data codes are stored in the memory device 23 in the recording and playback. In this instance, the memory device 23 is implemented by a hard disk driver. A flexible disk driver or floppy disk (trademark) driver, a compact disk driver such as, for example, a CD-ROM driver, a magnetic-optical disk driver, a ZIP disk driver, a DVD (Digital Versatile Disk) driver and a semiconductor memory board are available for the systems 300/500.

The hammer sensors 8, key sensors 7 and manipulating panel (not shown) are connected to the interface 24, and the pulse width modulator 25 distributes the driving signal ui to the solenoid-operated key actuators 6. The key position signals yxa and hammer position signals are continuously supplied from the key sensors 7 and hammer sensors 8 to the interface 24. Analog-to-digital converters A/D (see FIG. 3) are incorporated in the interface 24 so as to convert the hammer position signals and key position signals yxa to digital hammer position signals and digital key position signals yxd. The system clock signal periodically gives rise to a timer interruption for the central processing unit 20 so that the central processing unit 20 periodically fetches the pieces of positional data representative of the actual key positions and pieces of positional data representative of the actual hammer positions from the interface 24. The controller 302 may further include a communication interface, to which music data codes are supplied from a remote data source through a public communication network.

The driving signal ui is produced through the pulse width modulator 25, and is supplied to the solenoid-operated key actuators 6. The pulse width modulator 25 is responsive to a control signal, which is supplied from the central processing unit 20 so as to vary the mean current or duty ratio of the driving signal ui. Since the magnetic field is created in the presence of the driving signal ui, it is possible to control the force exerted on the plungers 9*a* and, accordingly, on the black/white keys 1*a*/1*b* with the driving signal ui. In this instance, the central processing unit 20, pulse width modulator 25, key actuators 6, key sensors 7 and interface 24 forms a servo-control loop 304, and the black and white keys 1*a*/1*b* are inserted into the servo-control loop 304.

Servo Control Loop

Figure 3:
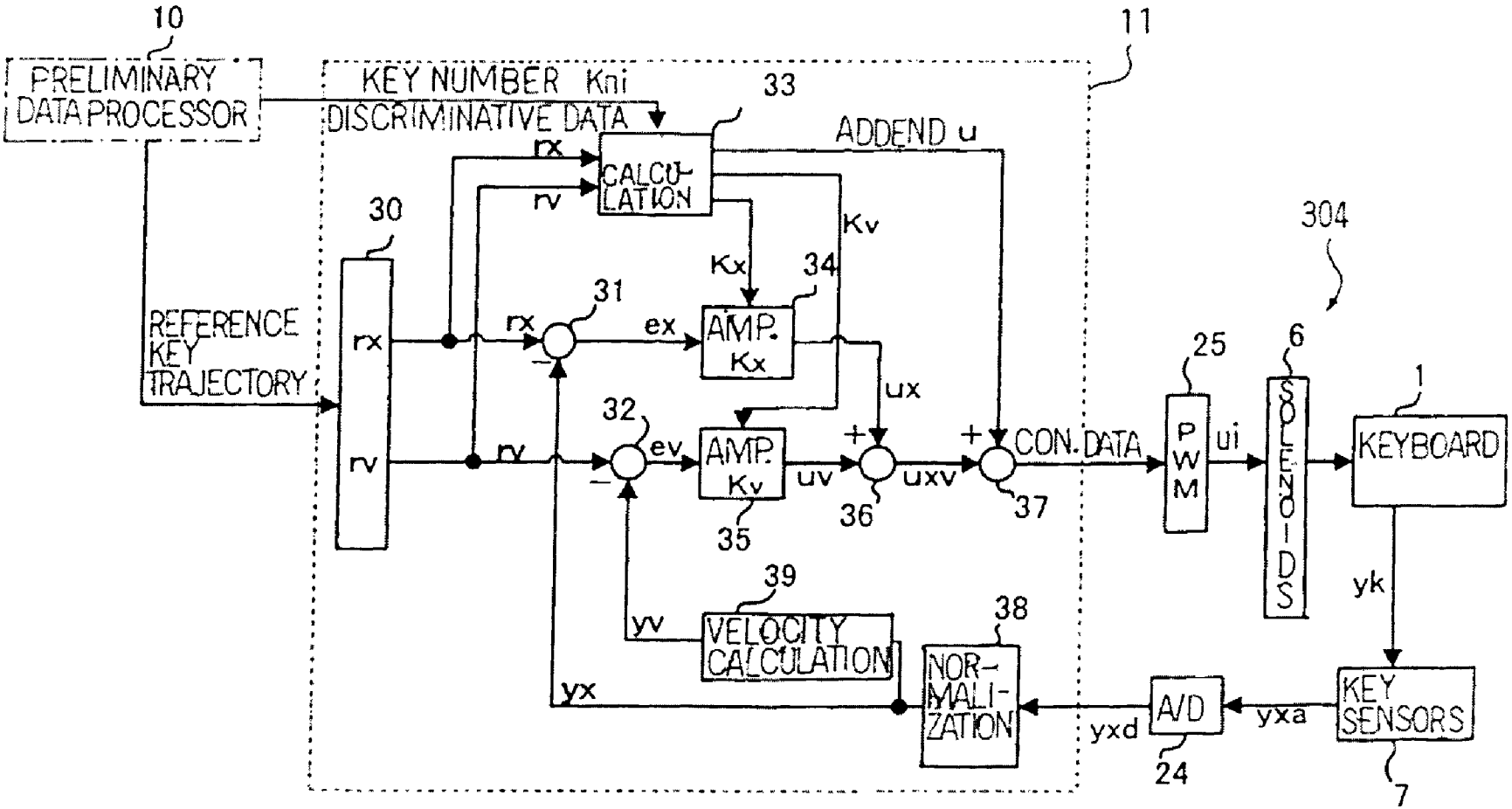
FIG. 3 is a block diagram showing a servo control loop incorporated in the automatic player piano.

FIG. 3 shows the function of the motion controller 11 for the servo control on the black/white keys 1*a*/1*b*. The motion controller 11 forms a servo control loop 304 together with the pulse width modulator 25, solenoid-operated key actuators 6, key sensors 7 and interface 24. In this instance, the motion controller 11 is implemented by the software.

In FIG. 3, circles 31 and 32 stand for subtractors, and circles 36 and 37 represent adders. The subtractor 31 determines a positional deviation ex between the target key position rx and the actual key position yx, and the other subtractor 32 determines a velocity deviation ev between the target key velocity rv and the actual key velocity yv.

Box 24 represents the analog-to-digital converter A/D incorporated in the interface 24, and box 30 stands for the determination of the target key position rx and target key velocity rv at each time period. The function of analog-to-digital converter A/D is well known to persons skilled in the art, and no further description on box 24 is hereinafter incorporated for the sake of simplicity. The central processing unit 20 fetches the digital key position signals yxd from the analog-to-digital converter 24 once in each sampling time period, and the data fetching is repeated at intervals of 1 millisecond. The sampling time period is equal to "each time period", and, accordingly, "each time period" is equal to 1 millisecond. The pieces of control data representative of the reference trajectories are supplied from the preliminary data processor 10 to box 30, and the target key position rx and target key velocity rv are determined in box 30. The target key velocity rv is calculated through the differentiation on a series of values of target key position rx. It is possible to determine the target key position on the basis of a series of values of target key velocity through the integration. Thus, the target key position and target key velocity are convertible physical quantities through the differentiation and integration.

Box 33 represents a calculator for gains kx/kv and added u. A piece of key data representative of the key number Kni and the pieces of discriminative data representative of the direction of keystroke are supplied from the preliminary data processor 10 to the calculator 33, and the target key position rx and target key velocity rv are further supplied from box 30 to the calculator 33. The calculator 33 determines a value of position gain kx, a value of velocity gain kv and addend u on the basis of the input data as will be hereinlater understood in detail. The position gain kx and velocity gain kv have influence on the response characteristics of the servo-control loop 304, and the response characteristics are optimized to the keys/hammers 1*a*/1*b*/3 with the addend u. In short, the calculator 33 takes the key motion and load or mass of hammers 3 to be driven through the black and white keys 1*a*/1*b* into account, and determines the control parameters kx, kv and u.

Boxes 34 and 35 stand for amplifiers. The amplifier 34 multiplies the positional deviation ex by the position gain kx, and the other amplifier 35 multiplies the velocity deviation ev by the velocity gain kv. The products ux and uv represent a percentage of the mean current due to the positional factor and another percentage of the mean current due to the velocity factor, respectively. Thus, the boxes 34 and 35 convert the stroke difference in millimeter and velocity difference in millimeter per second to a percentage due to the positional factor and another percentage due to the velocity factor.

The products ux and uv are added to one another at the adder 36, and the addend u is further added to the sum uxv, i.e., (ux+uv) at the adder 37. The total sum (ux+uv+u) is supplied from the adder 37 to the pulse width modulator 25 as the control data, and the pulse width modulator 25 adjusts the duty ratio of driving signal ui to the total sum (ux+uv+u). Thus, the motion controller 11 optimizes the response characteristics of servo-control loop 304 depending upon not only the positional deviation ex and velocity deviation ev but also the key number Kni and direction of key motion. This results in high fidelity in the automatic playing.

Boxes 25 and 38 stand for the function of the pulse width modulator 25 and normalization, respectively. Box 39 stands for a velocity calculator, which determines a value of the actual key velocity yv on the basis of a predetermined numbers of values of actual key positions on the actual key trajectory.

Control Parameter Tables

FIGS. 4A to 4E shows the control parameter tables employed in the servo control loop 304. While the black and white keys 1*a*/1*b* are traveling toward the end positions, the central processing unit 20 selectively accesses the control parameter tables shown in FIGS. 4A to 4C. On the other hand, the central processing unit 20 accesses the control parameter table shown in FIG. 4D during the backward motion toward the rest position, and accesses the control parameter table shown in FIG. 4E around the end of travels. The manufacturer determined a range of target key position rx, a range of target key velocity rv, a value of position gain kx, a value of velocity gain kv and a value of addend u through experiments, and tabled the results of the experiments as shown in FIGS. 4A to 4E.

The control parameter tables shown in FIGS. 4A to 4C are selectively accessed during the travel from the rest positions to the end positions depending upon the key number Kni assigned to the depressed keys 1*a*/1*b*. The control parameter table shown in FIG. 4A is assigned to the black and white keys 1*a*/1*b* with the key number Kni from 1 to 26, which are indicative of a lower pitched part, and the control parameter table shown in FIG. 4B is assigned to the black and white keys 1*a*/1*b* with the key number Kni from 27 to 68, which are indicative of a middle pitched part. If the key number Kni of the depressed key 1*a*/1*b* is fallen in the range from 69 to 88 or a higher pitched part, the central processing unit 20 accesses the control parameter table shown in FIG. 4C.

The position gain kx, velocity gain kv and addend u are varied depending upon the combination of the target key position rx and target key velocity rv. The keystroke between the rest position and the end position is divided into a shallow region, i.e., the keystroke from zero to 4 millimeters, and the deep region, i.e., the keystroke from 4 millimeters to 10 millimeters, and the threshold between the low speed and the high speed is 200 millimeters per second.

As will be understood, the criteria are the key number Kni, target key position rx and target key velocity rv. Although the target key position rx and target key velocity rv were taken into account for the control parameters of the prior art servo control loop, the key number Kni, which represents the load of hammers against the key motion, was ignored. The present inventor noticed the load of hammers substantial in the servo control. For this reason, the position gain kx, velocity gain kv and addend u are varied depending upon the combination of not only the target key position rx and target key velocity rv but also the key number Kni. This results in that the automatic player 300 can reproduce the original key motion at high fidelity in the playback.

Assuming now that a music data code represents the note-on event for a black or white key 1*a*/1*b* in the lower pitched part, the preliminary data processor 10 supplies the reference key trajectory, the key number Kni indicative of the black or white key 1*a*/1*b* to be depressed and the pieces of discriminative data representative of the forward key motion, i.e., the key motion toward the end position to the motion controller 11.

The motion controller 11 periodically determines the target key position rx and target key velocity rv, and accesses the control parameter table shown in FIG. 4A so as to read out the position gain kx, velocity gain kv and addend u from the control parameter table. As shown in FIG. 4A, the boundary B between the shallow region and the deep region floats depending upon the key number Kni. The boundary is expressed as $$B=6-0.04(KN-1) \quad \text{Equation 1}$$

where KN is the key number Kni. Thus, the boundary B is linearly varied together with the key number Kni between 5 millimeters and 6 millimeters. For example, when the left-most white key with the key number "1" is to be depressed, the boundary B is 6 millimeters, and the keystroke is divided into the shallow region from zero to 6 millimeters and the deep region from 6 millimeters to 10 millimeters. On the other hand, if the key number "26" is assigned to the key to be depressed, the boundary B is at 5 millimeters on the keystroke, and the keystroke is divided into the shallow region from zero to 5 millimeters and the deep region from 5 millimeters to 10 millimeters.

Upon determination of the boundary B, the central processing unit 20 checks the target key velocity rv to see whether the black or white key 1*a*/1*b* is traveling at high speed or low speed. If the black or white key 1*a*/1*b* is traveling at the low speed, the central processing unit 20 selects the first and second columns from the control parameter table. On the other hand, if the black or white key 1*a*/1*b* is traveling at the high speed, the central processing unit 20 selects the third and fourth column from the control parameter table. The central processing unit 20 further compares the target key position rx with the boundary B to see whether the black or white key 1*a*/1*b* is traveling in the shallow region or in the deep region.

If the black or white key 1*a*/1*b* is traveling in the shallow region at the low speed, the central processing unit 20 specifies the first column, and decides the position gain kx, velocity gain kv and addend u to be 0.6, 0.3 and 9%, respectively. If the black or white key 1*a*/1*b* is traveling in the deep region at the low speed, the central processing unit 20 specifies the second column, and decides the position gain kx, velocity gain kv and addend u to be 0.2, 0.3 and 9%, respectively. If the black or white key 1*a*/1*b* is traveling in the shallow region at the high speed, the central processing unit 20 specifies the third column, and decides the position gain kx, velocity gain kv and addend u to be 0.6, 0.3 and [9+2×(rv−100)/100] %, respectively. If the black or white key 1*a*/1*b* is traveling in the deep region at the high speed, the central processing unit 20 specifies the fourth column, and decides the position gain kx, velocity gain kv and addend u to be 0.2, 0.3 and [9+2×(rv−100)/100] %, respectively.

A black or white key 1*a*/1*b* to be depressed is assumed to be in the middle pitched part. The position gain kx, velocity gain kv and added u are to be read out from the control parameter table shown in FIG. 4B. The control parameter table shown in FIG. 4B also has four columns respectively assigned to the low speed key in the shallow region, low speed key in the deep region, high speed key in the shallow region and high speed key in the deep region. Although the boundary B between the shallow region and the deep region is varied in the control parameter table for the lower pitched part depending upon the key number Kni, the boundary is fixed to 4 millimeters in the control parameter table for the middle pitched part. The position gain kx, velocity gain kv and addend u in the four categories are equal to those in the control parameter table for the lower pitched part.

The automatic player 300 is assumed to be expected to give rise to the forward key motion for a black or white key 1*a*/1*b* in the higher pitched part. The boundary between the shallow region and the deep region is fixed to 4 millimeters, and the key velocity of 200 millimeters per second is the criterion between the high speed and the low speed as similar to those in the control parameter table for the middle pitched part. However, the position gain kx is variable in the shallow region regardless of the key velocity rv. The position gain kx is expressed as $$rv=0.6-(KN-68)/100 \quad \text{Equation 2}$$

where KN is the key number Kni. If the key number Kni is 69, the position gain kx is 0.59. When the key number Kni is increased to 78, the position gain kx is decreased to 0.5. However, when the key number Kni reaches the maximum number "88", the position gain kx is minimized to 0.4. Thus, the position gain kx is decreased from 0.59 to 0.4 inversely to the key number Kni from 69 to 88.

When the music data code is indicative of the backward motion toward the rest position, the position gain kx, velocity gain kv and addend u are fixed to 0.2, 0.7 and 9%, respectively, regardless of the target key velocity rv, target key position rx and key number Kni. Thus, the servo control loop 304 is enhanced in the promptness to the velocity deviation ev.

When the black and white keys 1*a*/1*b* stop at the end of the reference key trajectories, the position gain kx, velocity gain kv and addend u are give as shown in the control parameter table shown in FIG. 4E.

Servo Control

While the automatic player 300 is reenacting a performance, the servo control loop 304 behaves as follows. The eighty-eight keys 1*a*/1*b* are respectively assigned to time slots of each frame, and the motion controller 11 repeats the following servo-control for all the black and white keys 1*a*/1*b*.

A user is assumed to energize the automatic player 300. The automatic player 300 is firstly initialized, and reiterates a main routine for communication with the user. When the user instructs the automatic player 300 to reenact the performance, the main routine program branches into a subroutine program for the automatic playing, and the central processing unit 20 sequentially executes the programmed instructions for each of the black and white keys 1*a*/1*b* through timer interruptions. The central processing unit 20 controls a certain key 1*a*/1*b* through the subroutine program as follows.

The associated key sensor 7 continuously supplies the analog key position signal yxa to the interface 24, and the analog key position signal yxa is converted to a digital key position signal yxd by means of the analog-to-digital converter A/D. The digital key position signal yxd is supplied from the interface 24 to the box 38, and the individuality is eliminated from the discrete value of the digital key position signal yxd through the normalization in the box 38. Moreover, the discrete value of the digital key position signal yxd is converted to another discrete value representative of the actual key position yx through the normalization in order to make the unit consistent with that of the target key position rx. In this instance, the actual key position yx and target key position rx are expressed in millimeter.

The actual key position yx is supplied to the box 39 and circle 31. A series of values of actual key position yx is read out from the working memory 22, and the actual key velocity yv is calculated in the box 39. In this instance, the actual key velocity yv is determined through a polynominal approximation. For example, when the box 39 determines the actual key velocity yv at a certain actual key position, the central processing unit 20 reads out three values of actual key position yx stored in the working memory 22 through the previous three sampling operations and three values of actual key position stored in the working memory 22 through the three sampling operations next to the sampling operation for the certain actual key position, and the total seven values of actual key position are approximated to a second-order curve, and determines the actual key velocity yv from the second-order curve. The actual key position yx and actual key velocity kv are respectively supplied to the circles 31 and 32. While the black and white keys 1*a*/1*b* are staying at the rest positions, the actual key position yx is equivalent to the keystroke of zero, and the actual key velocity yv is also zero.

The time to start the key motion comes. The preliminary data processor 10 informs the reference key trajectory to the box 30, and the target key position rx and target key velocity rv are determined in the box 30. The target key position rx and target key velocity rv are output from the box 30 at intervals equal to the sampling time period, i.e., 1 millisecond. For this reason, the target key position rx and target key velocity rv are always paired with the actual key position yx and actual key velocity yv, respectively.

The box 30 informs the box 33 and circles 31/32 of the target key position rx and target key velocity rv. The value of actual key position yx is subtracted from the value of target key position rx in the circle 31 so as to determine the positional deviation ex. On the other hand, the value of actual key velocity yv is subtracted from the value of target key velocity rv so as to determine the velocity deviation ev. The positional deviation ex and velocity deviation ev are respectively output from the circles 31/32 to the boxes 34 and 35.

On the other hand, the position gain kx, velocity gain kv and addend u are determined on the basis of the key number Kni, direction of key motion, target key position rx and target key velocity rv, and are output from the box 33 to the boxes 34/35 and circle 37. The positional deviation ex and velocity deviation ev are respectively multiplied by the positional gain kx and velocity gain kv, and the product ux is added to the product uv in the circle 36, and the addend u is added to the sum of products uxv in the circle 37. The total sum (uxv+u) expresses the mean current of the driving signal ui, and is supplied to the pulse width modulator 25. The pulse width modulator 25 adjusts the driving signal ui to a duty ratio equivalent to the mean current (uxv+u), and supplies the driving signal ui to the solenoid-operated key actuator 6. The driving signal ui makes the magnetic field strong, and the magnetic force exerted on the plunger 9*a* is increased. As a result, the plunger 9*a* further projects, and pushes up the rear portion of the certain key 1*a*/1*b*. The servo control loop 304 repeats the above-described control sequence until the end of the automatic playing.

Figure 5:
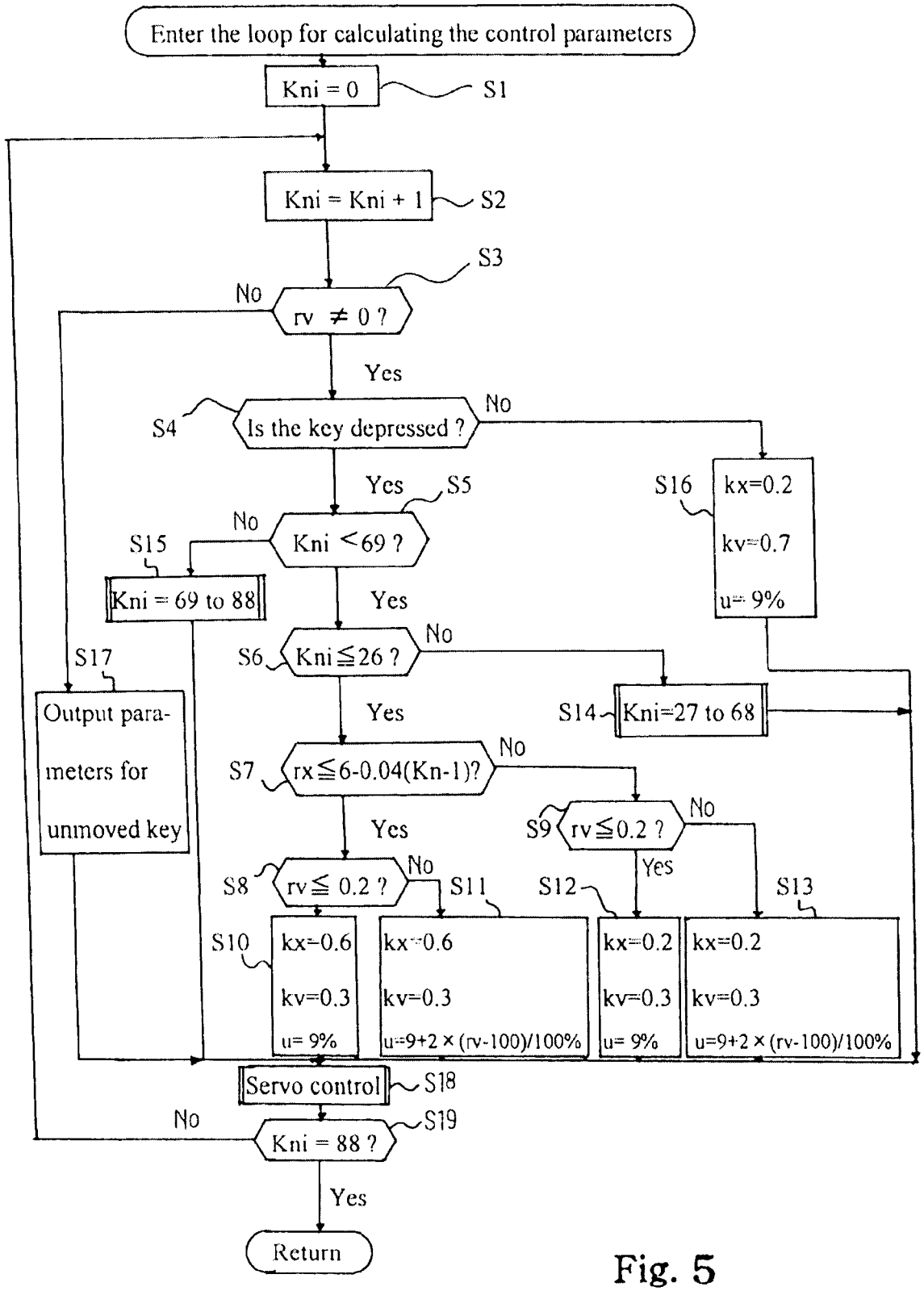
FIG. 5 is a flow chart showing a sequence of jobs for determining the control parameters.
Figure 6:
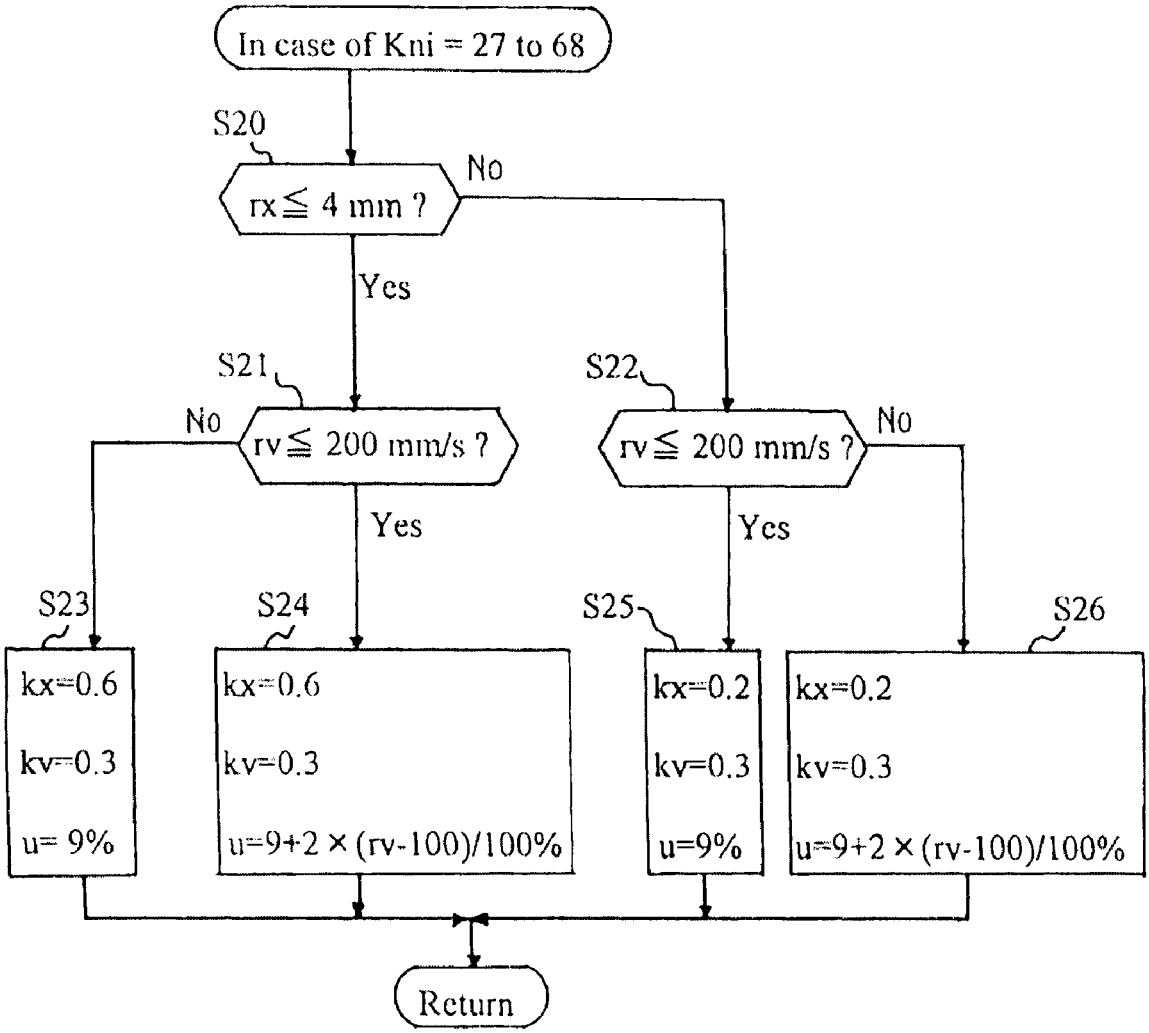
FIG. 6 is a flowchart showing jobs accomplished in the sequence for key numbers from 27 to 68.
Figure 7:
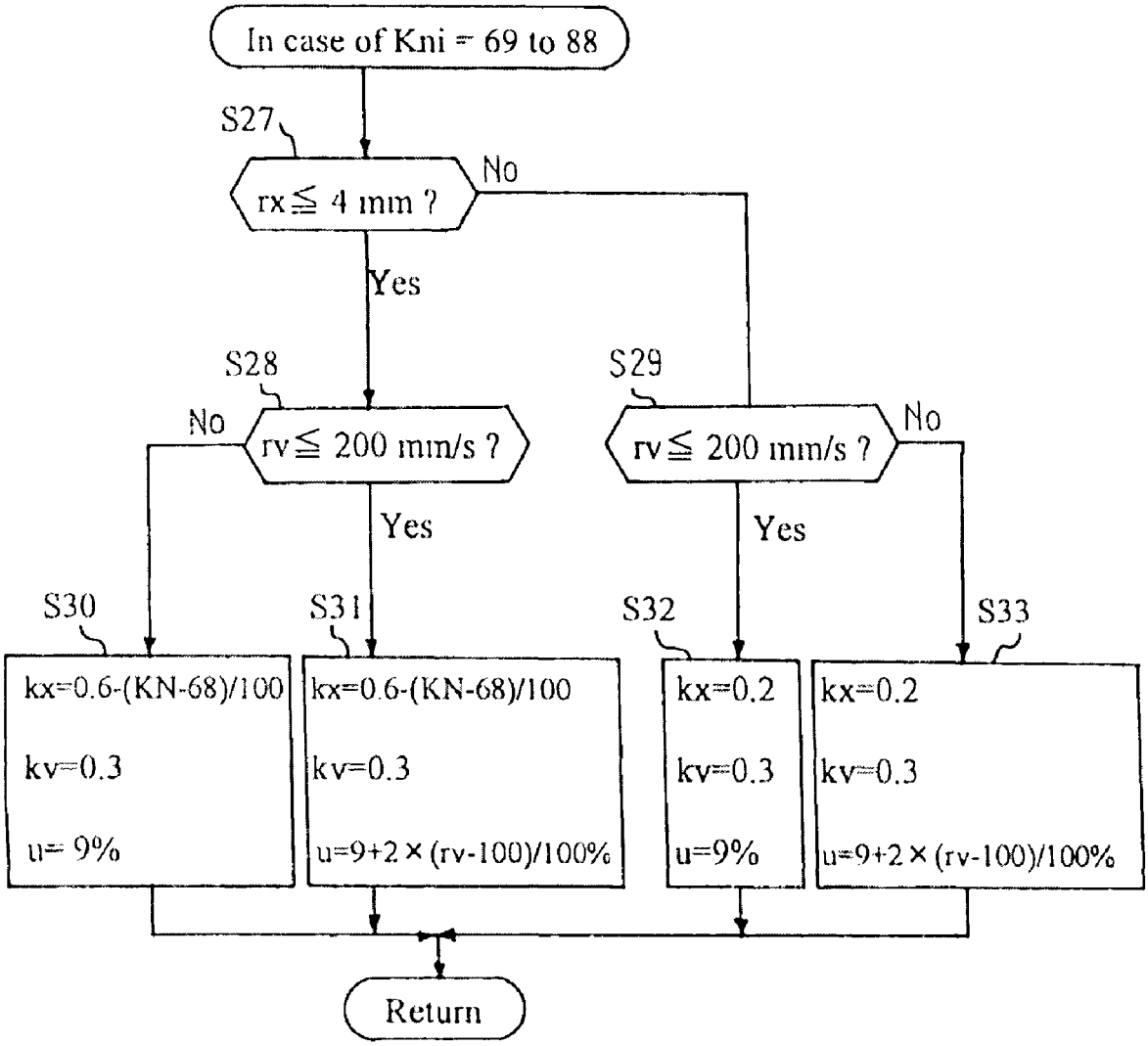
FIG. 7 is a flowchart showing jobs accomplished in the sequence for key numbers from 69 to 88.

The position gain kx, velocity gain kv and addend u are determined in the box 33 as follows. FIGS. 5, 6 and 7 show a sequence of jobs accomplished by the box 33. It is assumed that the piece of control data representative of the key number Kni, piece of discriminative data representative of the direction of key motion and pieces of control data representative of the target key position rx and target key velocity rv reach the box 33 at certain timing in the servo-control. The central processing unit 20 firstly resets the key number Kni zero as by step S1, and increments the key number Kni as by step S2. The key number Kni is indicative of the leftmost white key with the key number "1" at the first execution immediately after the step S1. While the central processing unit 20 is repeating the loop consisting of steps S2 to S19, the key number Kni is stepwise incremented by "1".

Upon completion of the job at step S2, the central processing unit 20 checks the target key velocity rv to see whether or not the black or white key 1*a*/1*b* has already started the key motion as by step S3. While the black or white key 1*a*/1*b* is idling at the rest position, the target key velocity rv is zero, and the answer at step S3 is given negative "No". Then, the central processing unit 20 accesses the control parameter table shown in FIG. 4E, and outputs the position gain kx, velocity gain kv and addend u to the boxes 34/35 and circle 37, respectively, as by step S17. The central processing unit 20 determines the mean current of the driving signal as described hereinbefore, and carries out the servo-control on the black or white key 1*a*/1*b* as by step S18.

Subsequently, the central processing unit 20 compares the present key number Kni with the maximum key number "88" to see whether or not the servo control has been already carried out on the rightmost white key 1*b* as by step S19. While the answer at step S19 is given negative "No", the central processing unit 20 returns to step S2, and repeats the servo control on the remaining keys 1*a*/1*b*. When the rightmost white key 1*b* was subjected to the servo-control at step S18, the answer at step S19 is given affirmative "Yes", and the central proceeding unit 20 returns to the previous subroutine program.

If the black or white key 1*a*/1*b* has started the travel on the reference key trajectory, the answer at step S3 is given affirmative "Yes", and the central processing unit 20 checks the piece of discriminative data to see whether the black or white key 1*a*/1*b* is depressed or released as by step S4. While the piece of discriminative data is representative of the forward key motion, the answer at step S4 is given affirmative "Yes", and the central processing unit 20 proceeds to step S5.

On the other hand, when the black or white key 1*a*/1*b* is found in the backward key motion, the answer at step S4 is given negative "No", and the central processing unit 20 accesses the control parameter table shown in FIG. 4D. The central processing unit 20 decides the position gain kx, velocity gain kv and addend u to be 0.2, 0.7 and 9% as by step S16, and proceeds to step S18 for the servo control.

While the black or white key 1*a*/1*b* is found on the way toward the end position, the answer at step S4 is given affirmative "Yes", and the central processing unit 20 proceeds to step S5. The job at step S5 is to compare the key number Kni with the key number "69" see whether or not the black or white key 1*a*/1*b* belongs to the middle pitched part or lower pitched part.

When the key number Kni is less than 69, the black or white key 1*a*/1*b* belongs to either middle pitched part or lower pitched part, and the answer at step S5 is give affirmative "Yes". With the positive answer "Yes", the central processing unit 20 compares the key number Kni with the key number "26" to see whether the black or white key 1*a*/1*b* belongs to the lower pitched part or the middle pitched part as by step S6.

The black or white key 1*a*/1*b* is assumed to belong to the lower pitched part, the key number Kni given thereto is equal to or less than "26", and the answer at step S6 is given affirmative "Yes". With the positive answer "Yes", the central processing unit 20 calculates the boundary B between the shallow region and the deep region, i.e., [6−0.04(KN−1)], and compares target key position rx with the boundary B to see whether the black or white key 1*a*/1*b* is traveling in the shallow region or the deep region as by step S7. When the black or white key 1*a*/1*b* is found in the shallow region, the answer at step S7 is given affirmative "Yes", and the central processing unit 20 compares the target key velocity rv with the threshold value, i.e., 0.2 meter per second to see whether the black or white key 1*a*/1*b* is traveling in the shallow region at the low speed or at the high speed as by step S8. Even if the black or white key 1*a*/1*b* is found in the deep region, the central processing unit 20 compares the target key velocity rv with the threshold value to see whether or not the black or whit key 1*a*/1*b* is traveling in the deep region at the low speed or at the high speed as by step S9. Thus, the key motion is sorted into any one of the four categories.

While the black or white key 1*a*/1*b* is traveling in the shallow region at the low speed, the key motion is categorized in the first group, and the central processing unit 20 decides the position gain kx, velocity gain kv and addend u to be 0.6, 0.3 and 9%, respectively, as by step S10.

While the black or white key 1*a*/1*b* is traveling in the shallow region at the high speed, the key motion is categorized in the second group, and the central processing unit 20 decides the position gain kx, velocity gain kv and addend u to be 0.6, 0.3 and (9+2×(rv−100)/100) %, respectively, as by step S11.

While the black or white key 1*a*/1*b* is traveling in the deep region at the low speed, the key motion is categorized in the third group, and the central processing unit 20 decides the position gain kx, velocity gain kv and addend u to be 0.2, 0.3 and 9%, respectively, as by step S12.

While the black or white key 1*a*/1*b* is traveling in the deep region at the high speed, the key motion is categorized in the fourth group, and the central processing unit 20 decides the position gain kx, velocity gain kv and addend u to be 0.2, 0.3 and (9+2×(rv−100)/100) %, respectively, as by step S13.

Upon completion of the job at S10, S11, S12 or S13, the central processing unit 20 proceeds to step S18, and optimizes the mean current of the driving signal ui for the servo control.

The black or white key 1*a*/1*b* is assumed to belong to the middle pitched part. The answer at step S6 is given negative "No", and the central processing unit 20 proceeds to step S14. The jobs at step S14 is illustrated in FIG. 6 in more detail. First, the central processing unit 20 compares the target key position rx with the boundary between the shallow region and the deep region, i.e., 4 millimeters to see whether the black or white key 1*a*/1*b* is traveling in the shallow region or the deep region as by step S20. If the black or white key 1*a*/1*b* is found in the shallow region, the answer at step S20 is given affirmative "Yes", and the central processing unit 20 further compares the target key velocity rv with the threshold value, i.e., 200 millimeters per second to see whether the black or white key 1*a*/1*b* is traveling in the shallow region at the low speed or the high speed as by step S21. When the black or white key 1*a*/1*b* is found in the deep region, the answer at step S21 is given negative "No", and the central processing unit 20 further compares the target key velocity rv with the threshold value to see whether the black or white key 1*a*/ 1*b* is traveling in the deep region at the low speed or at the high speed as by step S22.

The key motion is categorized in one of the fur groups depending upon the answers at steps S20/S21 or S20/S22 as follows.

While the black or white key 1*a*/1*b* is traveling in the shallow region at the low speed, the key motion is categorized in the first group, and the central processing unit 20 decides the position gain kx, velocity gain kv and addend u to be 0.6, 0.3 and 9%, respectively, as by step S23.

While the black or white key 1*a*/1*b* is traveling in the shallow region at the high speed, the key motion is categorized in the second group, and the central processing unit 20 decides the position gain kx, velocity gain kv and addend u to be 0.6, 0.3 and (9+2×(rv−100)/100) %, respectively, as by step S24.

While the black or white key 1*a*/1*b* is traveling in the deep region at the low speed, the key motion is categorized in the third group, and the central processing unit 20 decides the position gain kx, velocity gain kv and addend u to be 0.2, 0.3 and 9%, respectively, as by step S25.

While the black or white key 1*a*/1*b* is traveling in the deep region at the high speed, the key motion is categorized in the fourth group, and the central processing unit 20 decides the position gain kx, velocity gain kv and addend u to be 0.2, 0.3 and (9+2×(rv−100)/100) %, respectively, as by step S26. Upon completion of the job at S23, S24, S25 or S26, the central processing unit 20 proceeds to step S18, and optimizes the mean current of the driving signal ui for the servo control.

When the black or white key 1*a*/1*b* belongs to the higher pitched part, the answer at step S5 is given negative "No", and central processing unit 20 proceeds to step S15. The jobs at step S15 is illustrated in FIG. 7 in more detail.

First, the central processing unit 20 compares the target key position rx with the boundary between the shallow region and the deep region, i.e., 4 millimeters to see whether the black or white key 1*a*/1*b* is traveling in the shallow region or the deep region as by step S27. If the black or white key 1*a*/1*b* is found in the shallow region, the answer at step S27 is given affirmative "Yes", and the central processing unit 20 further compares the target key velocity rv with the threshold value, i.e., 200 millimeters per second to see whether the black or white key 1*a*/1*b* is traveling in the shallow region at the low speed or the high speed as by step S28. When the black or white key 1*a*/ 1*b* is found in the deep region, the answer at step S27 is given negative "No", and the central processing unit 20 further compares the target key velocity rv with the threshold value to see whether the black or white key 1*a*/1*b* is traveling in the deep region at the low speed or at the high speed as by step S29.

The key motion is categorized in one of the fur groups depending upon the answers at steps S27/S281 or S270/S292 as follows.

While the black or white key 1*a*/1*b* is traveling in the shallow region at the low speed, the key motion is categorized in the first group, and the central processing unit 20 decides the position gain kx, velocity gain kv and addend u to be (0.6−(KN−68)/100), 0.3 and 9%, respectively, as by step S30.

While the black or white key 1*a*/1*b* is traveling in the shallow region at the high speed, the key motion is categorized in the second group, and the central processing unit 20 decides the position gain kx, velocity gain kv and addend u to be (0.6−(KN−68)/100), 0.3 and (9+2×(rv−100)/100) %, respectively, as by step S31.

While the black or white key 1*a*/1*b* is traveling in the deep region at the low speed, the key motion is categorized in the third group, and the central processing unit 20 decides the position gain kx, velocity gain kv and addend u to be 0.2, 0.3 and 9%, respectively, as by step S32.

While the black or white key 1*a*/1*b* is traveling in the deep region at the high speed, the key motion is categorized in the fourth group, and the central processing unit 20 decides the position gain kx, velocity gain kv and addend u to be 0.2, 0.3 and (9+2×(rv−100)/100) %, respectively, as by step S33.

Upon completion of the job at S30, S31, S32 or S33, the central processing unit 20 proceeds to step S 18, and optimizes the mean current of the driving signal ui for the servo control.

As will be understood from the foregoing description, the control parameters kx, kv and u are different depending upon the pitched part, and are optimized to the load against the key motion, i.e., the mass of hammers 3. Even though the black and white keys 1*a*/1*b* belong to the lower pitched part, the boundary B between the shallow region and the deep region is varied between 6 millimeters and 5 millimeters depending upon the key number Kni and, accordingly, the load against the key motion.

The larger the load is, the longer the shallow region is. The position gain kx in the shallow region is larger than that in the deep region, i.e., 0.6>0.2 so that the motion controller 11 tries strongly to minimize the positional deviation ex for the black or white key 1*a*/1*b* assigned the small key number Kni. When the solenoid-operated key actuator 6 is expected to drive the left-most key 1*b* in the lower pitched part, the shallow region for the leftmost key 1*b* is 6 millimeters long, and the motion controller 11 keeps the position gain kx large, i.e., 0.6. However, when the solenoid-operated key actuator 6 is expected to drive the rightmost key in the lower pitched part, the shallow region is shortened to 5 millimeters long, and the motion controller 11 reduces the position gain kx to 0.2 between the keystroke of 5 millimeters to 6 millimeters. In other words, the mean current between 5 millimeters and 6 millimeters for the rightmost key is smaller in value than that for the leftmost key in so far as the positional deviation ex and velocity deviation ev are equal between the rightmost key and the leftmost key. The hammer 3 to be driven by the leftmost key is heavier than the hammer 3 to be driven by the rightmost key. Although the load on the leftmost key is heavier than the load on the rightmost key, the motion controller 11 keeps the compelling power large in the long shallow region for the leftmost key so that the leftmost key easily causes the heavy hammer to reach the target value of the final hammer velocity. This results in that the automatic player 300 reenacts the performance at high fidelity.

In the higher pitched part, the position gain kx per se is varied in the shallow region depending upon the key number Kni as will be understood from steps S30 and S31. In detail, the position gain kx in the shallow region is given as (0.6−(KN−68)/100). When the key is located at the leftmost of the higher pitched part, KN is 68 so that the position gain kx is 0.6. On the other hand, the key at the rightmost of the higher pitched part is assigned the key number of "88" so that the position gain kx is decreased to 0.58. The larger the key number Kni is, the smaller the position gain kx is. In other words, the motion controller 11 makes the promptness to the positional deviation ex dull for the black or white key assigned a large key number Kni so that the promptness to the velocity deviation ev is made relatively strong. As a result, the unstable key motion is restricted.

Comparing the position gain kx in the shallow region with the position gain kx in the deep region, it is understood from the control parameter tables shown in FIGS. 4A to 4C, the motion controller 11 focuses the effort on the elimination of the positional deviation ex in the shallow region stronger than the effort in the deep region. Moreover, when the motion controller 11 finds the black and white keys 1*a*/1*b* on the reference key trajectories at the high speed, i.e., the motion controller 11 makes the addend u varied together with the target key velocity rv, because the addend u is given as (9+2(rv−100)/ 100) %. This results in that the promptness to the velocity deviation ev is enhanced. In other words, the motion controller 11 forces the black and white keys 1*a*/1*b* promptly to catch up the target key velocity rv.

Thus, the motion controller 11 takes not only the key motion, which the target key position rx and target key velocity express, but also the load against the key motion into account for the control parameters kx, kv and u so that the automatic player 300 can reenact the performance expressed by a set of music data codes at high fidelity.

Second Embodiment

An automatic player piano embodying the present invention is similar to the automatic player piano implementing the first embodiment except for a control parameter table for the lower pitched part. For this reason, description is focused on the control parameter table for the lower pitched part. When the component parts of the automatic player piano are referred to, the names of component parts are followed by reference numerals designating corresponding component parts of the automatic player piano implementing the first embodiment.

In the control parameter table shown in FIG. 4A, the boundary B between the shallow region and the deep region is varied as shown in Equation 1, and is successively varied together with the key number Kni. On the other hand, the boundary B' between the shallow region and the deep region is varied depending upon the key groups in the control parameter table incorporated in the second embodiment. The black and white keys in the lower pitched part are divided into plural key groups. In case where n keys are incorporated in each key group, the boundary B' between the shallow region and the deep region is varied as $$B'=6-0.04\times(n\times[KN/n]-1) \qquad \text{Equation 3}$$

where [ ] is Gauss' notation.

In this instance, the boundary B' is fixed to a certain value for each key group, and is stepwise varied from a key group to another key group. This feature is suitable for simple models of acoustic pianos, because the manufacturer can prepare and memorize the boundaries B' in the control parameter tables.

Although particular embodiments of the present invention have been shown and described, it will be apparent to those skilled in the art that various changes and modifications may be made without departing from the spirit and scope of the present invention.

First, the automatic player piano does not set any limit to the technical scope of the present invention. The present invention may appertain to another sort of automatic player musical instruments in so far as the load is different among the manipulators.

The grand piano 100 does not set any limit to the technical scope of the present invention. The grand piano may replaced with an upright piano. The automatic player 300 according to the present invention may be installed in another sort of keyboard musical instrument such as, for example, a harpsichord, an organ and a mute piano. Moreover, the automatic player according to the present invention may be installed in another sort of musical instrument such as, for example, a celesta.

The present invention may be applied to the pedals of an automatic player piano. Since the dampers and keyboard apply different loads on the pedals, the controller optimizes the driving signals supplied to solenoid-operated pedal actuators. Thus, the black and white keys 1*a*/1*b* do not set any limit to the technical scope of the present invention.

The position gain kx, velocity gain kv and added u shown in FIGS. 4A to 4E are appropriate for a certain model of grand piano 100, and do not set any limit to the technical scope of the present invention. Another set of control parameter tables may be prepared for another model of grand piano or a certain model of upright piano.

The keyboard 1 may be divided into two or more than three pitched parts. If the keyboard is divided into two pitched parts, two control parameter tables are prepared for the automatic player. If, on the other hand, the keyboard is divided into more than three pitched parts, the control parameter tables are equal to the pitched parts. In an extreme case, the control parameter tables are respectively prepared for all the black and white keys.

Moreover, the control parameters may be given in the form of equations. In this instance, the central processing unit calculates the control parameters by using the equations.

The optical transducers do not set any limit to the technical scope of the present invention. For example, another sort of position sensor, which may be implemented by a potentiometer, may be incorporated in the automatic player. The optical transducer may be replaced with a combination of a piece of permanent magnet and a Hall element as the key sensors 7 and/or hammer sensors 8. Otherwise, a semiconductor acceleration sensor may be formed on a semiconductor chip attached to the black and white keys 1*a*/1*b* and hammers 3. The semiconductor acceleration sensor may be implemented by a weight piece supported by beams where resistors are formed as the parts of the Wheatstone bridge. Thus, the key sensors and hammer sensors may directly convert the key velocity/hammer velocity or the acceleration to electric signals.

The pulse width modulator does not set any limit to the technical scope of the present invention. The potential level of the driving signal ui may be directly controlled through a voltage transformer.

The servo-control loop 304 may be implemented by a logic circuit. A suitable digital signal processor may be incorporated in the automatic player for the signal processing.

The servo-control loop 304 may be implemented by a logic circuit. A suitable digital signal processor may be incorporated in the automatic player for the signal processing.

The key acceleration may be taken into account in the servo-control. In this instance, an acceleration gain is further stored in the control parameter tables, and a deviation between a target acceleration and an actual acceleration is multiplied by the acceleration gain. In case where the acceleration is taken into account together with the position and velocity, the target key acceleration and actual key acceleration are determined on the basis of the target key velocity rv and actual key velocity yv through the differentiation, and the deviation therebetween is calculated at a third subtractor. The acceleration deviation is multiplied by the acceleration gain, and the product is added to the other products. The addend is further added to the sum of products, and determines the target duty ratio.

The motion controller 11 may employ the actual key position yx and actual key velocity yv in the preparation of the control parameters kx, kv and u. In this instance, the actual key position yx and actual key velocity yv are reported from the boxes 38/39 to the box 33.

The position gain kx may be varied together with the key number Kni for all of the black and white keys 1*a*/1*b*. In other words, the variable position gain kx is not restricted to the black and white keys 1*a*/1*b* in the higher pitched part traveling in the shallow region (see the control parameter table 4C). Even so, the position gain kx for the key assigned a small key number is to be larger than the position gain kx for the key assigned a large key number.

Moreover, the boundary B between the shallow region and the deep region may be varied together with the key number Kni for all of the black and white keys 1*a*/1*b*. In the first embodiment, the boundary B is linearly varied together with the key number Kni. However, the boundary B may be varied non-linearly in a set of control parameter tables for another embodiment.

In the control parameter table for the released keys, the control parameters may be different between the shallow region and the deep region.

The control parameters kx, kv and u may be directly read out from the control parameter tables without any calculation, which are, by way of example, carried out at steps S5 and S6. In this instance, all the control parameters are prepared for the key motion on the reference trajectories, and are memorized in a suitable memory.

The jobs in the flowchart may be achieved through wired logic circuits.

The component parts and are correlated with claim languages as follows. The acoustic piano 100 serves as a "musical instrument", and the black and white keys 1*a*/1*b*, action units 2, hammers 3 and dampers 5 as a whole constitute "plural link works". The strings 4 are corresponding to a "tone generator". The solenoid-operated key actuators 6 are corresponding to "plural actuators", and key sensors 7 serve as "plural sensors". The preliminary data processor 10 and motion controller 11 as a whole constitute a "controller".

The key position signals yxa are equivalent to "detecting signals", and the key sensors 7 report the actual key positions, which is corresponding to an "actual physical quantity", of the associated black and white keys 1*a*/1*b* to the controller. "Motion" of the black and white keys 1*a*/1*b* are expressed by the actual key positions, and the "motion presently expected on the reference trajectories" is expressed by the target key position rx and target key velocity rv. The mean current or duty ratio of the driving signals ui is corresponding to "magnitude" of the driving signal. The positional deviation ex and velocity deviation ev express "difference" between the motion expressed by the actual physical quantity and the motion presently expected on the reference trajectories. The position gain kx, velocity gain kv and addend u serve as "control parameters".

What is claimed is:

1. A method for reenacting a performance represented by a set of pieces of music data through a musical instrument, comprising the steps of:

a) determining a reference trajectory, on which a linkwork incorporated in said musical instrument is to travel so as to cause a tone generator to produce a tone, on the basis of a piece of music data incorporated in said set;

b) acquiring a piece of detecting data representative of an actual physical quantity expressing motion of said linkwork;

c) comparing said motion expressed by said actual physical quantity with the motion presently expected on said reference trajectory to see whether or not a difference takes place therebetween;

d) determining control parameters varied together with said motion and mass of said linkwork when the answer at said step c) is given affirmative;

e) determining a new value of magnitude of a driving signal on the basis of said difference and said control parameters;

f) supplying said driving signal to an actuator associated with said linkwork so that said actuator exerts force corresponding to said new value of said magnitude on said linkwork, thereby forcing said linkwork to travel on said reference trajectory;

g) keeping said driving signal at a prevent value of said magnitude so that said linkwork continuously travels on said reference trajectory when said answer at said step c) is given negative; and h) repeating said steps a) to g) until said linkwork reaches the end of said reference trajectory.

2. The method as set forth in claim 1, wherein said actual physical quantity and another actual physical quantity are selected from the group consisting of position, velocity and acceleration, and said motion presently expected on said reference trajectory are expressed by a target physical quantity corresponding to said actual physical quantity and another target physical quantity corresponding to said another actual physical quantity so that a deviation between said actual physical quantity and said target physical quantity and another deviation between said another actual physical quantity and said another target physical quantity are determined in said step c) so as to determine whether or not said difference takes place.

3. The method as set forth in claim 2, wherein said deviation and said another deviation are respectively multiplied by one of said control parameters and another of said control parameters, and yet another of said control parameters is added to the sum of the product between said deviation and said one of said control parameters and the product between said another deviation and said another of said control parameters so as to determine said new value of said magnitude in said step e).

* * * * *